United States Patent [19]

Gregerson et al.

[11] Patent Number: 4,759,442

[45] Date of Patent: Jul. 26, 1988

[54] SECURITY PACKAGE

[75] Inventors: Barry Gregerson; Larry Dressen, both of Chanhassen, Minn.

[73] Assignee: Empak, Inc., Chanhassen, Minn.

[21] Appl. No.: 108,071

[22] Filed: Oct. 15, 1987

Related U.S. Application Data

[63] Continuation of Ser. No. 877,859, Jun. 24, 1986, abandoned.

[51] Int. Cl.[4] ..... B65D 85/672

[52] U.S. Cl. ..... 206/387; 206/1.5; 206/807

[58] Field of Search ..... 206/1.5, 387, 807, 307, 206/444; 220/284, 315

[56] References Cited

U.S. PATENT DOCUMENTS

| | | | |
|---|---|---|---|
| 3,495,716 | 2/1970 | Gregory | 206/387 X |
| 3,746,206 | 7/1973 | Utz | 280/214 |
| 3,828,922 | 8/1974 | Holkestad | 206/387 X |
| 3,871,516 | 3/1975 | Holkestad et al. | 206/387 X |
| 4,245,741 | 1/1981 | Holkestad | 206/387 |
| 4,285,429 | 8/1981 | MacTavish | 206/387 |
| 4,381,836 | 5/1983 | Rivkin et al. | 206/387 |
| 4,567,983 | 2/1986 | Morris | 206/387 |

*Primary Examiner*—Stephen Marcus
*Assistant Examiner*—T. Graveline
*Attorney, Agent, or Firm*—Hugh D. Jaeger

[57] ABSTRACT

Security package including a handle structure secured to a rectangular encompassing structure for encompassing about an audio or visual cassette box or a compact disk jewel box. Retainer bars in the rectangular encompassing structure provide for retaining either an audio cassette or a video cassette box, or a compact disk box within the rectangular encompassing structure. A retainer box including a pin is pushed through a hole in the encompassing structure, and is in frictional secure engagement which provides for retaining of the box within the rectangular encompassing structure. The retaining bar-pin can be removed with common hand tools or, in the alternative, end retainer bars can be cut for separation of the ends of the rectangular encompassing structure for removing the box from the encompassing security package.

5 Claims, 7 Drawing Sheets

SECURITY PACKAGE

This is a continuation of application Ser. No. 877,859, filed June 24, 1986 and now abandoned.

BACKGROUND OF THE INVENTION

1. Field of the Invention

The present invention pertains to a security package and, more particularly, pertains to a structure with a handle and a rectangular encompassing structure for encompassing about an audio cassette, a video cassette box, or a compact disk jewel box. The package provides for protection against shoplifting and pilfering.

2. Background of the Invention

It has become a common problem in the marketplace for the need to secure audio-visual materials such as audio cassette boxes, video cassette boxes, and now the ever popular compact jewel boxes in a security package. While these audio-visual products are packaged in plastic or cardboard display cases, the cassette boxes or jewel boxes are of such a size as to easily lend themselves through the "sticky fingers" theory to "fall" into someone's coat pocket, purse or bag. Especially with the ever increasing price of video cassettes and compact disks, the losses of audio-visual products become expensive to the vendors, and are even significant even if only a few cassettes or disks are stolen per month.

The prior art resolutions to the problem have not been very acceptable. Keeping the material behind the counters and off the shelves is not cost effective, let alone labor effective, and also unfortunately leads to "stealing" by employees of a vendor. Another problem is that the prior art packages are easily opened, such as those made of a plastic film material, so that anyone with a knife can literally cut the package apart and steal the contents accordingly.

The present invention provides a security package which is light-weight, secure, and literally indestructible and which requires retainer bar-pin removal for subsequent use of the security package contents.

SUMMARY OF THE INVENTION

The general purpose of the present invention is a security package for encompassing a video or audio cassette box, or compact disk box or any other article providing for securement of the article inside the package, as well as prevention of shoplifting or stealing of the article.

According to one embodiment of the present invention, there is provided a security package with a handle structure and a rectangular encompassing structure which retains a plastic box such as that for an audio cassette box, a VCR cassette box, or compact disk jewel box within retainer bars, while still providing for viewing of the printed material. An aligned containment retainer bar-pin inserts through a hole adjacent to and partially over the rectangular like encompassing structure under pressure. The bar-pin is in frictional engagement in an engagement orifice, and extends over the encompassing area. This secures the article to prevent removal of a box from within the encompassing rectangular like structure. Each of the lower retainer bars in the lower end of the encompassing structure may be cut for separation of the retainer ends of the encompassing structure for removal of structure contents. The bar-pin may also be removed, such as with a punch and hammer device, or a containment bar-pin removal machine for subsequent removal of the box from the encompassing security package structure.

One significant aspect and feature of the present invention is a security package with a self-aligning one way compression fit bar-pin secured over and about the contents of the security package.

Another significant aspect and feature of the present invention is a bar-pin which can be inserted and fixed into position manually without the use of special insertion devices.

Another significant aspect and feature of the present invention is a sturdy, secure, security package for audio or visual boxes which is not easily pocketable nor accommodated in a purse or bag or under clothing without being inherently obvious to an ordinary onlooker. The security package is a prevention against shoplifting.

Yet another significant aspect and feature of the present invention is a security package with an encompassing structure which securely encloses a plastic box such as a cassette box or jewel box for protection of goods therein. An audio or visual box cannot be removed because of being secured within the encompassing structure without being inherently obvious to someone during attempted removal.

A further significant aspect and feature of the present invention is a security package which is suitable for placement on store shelves or sales racks, and is esthetically pleasing for presentation of the goods.

BRIEF DESCRIPTION OF THE DRAWINGS

Other objects and many of the attending advantages of the present invention will be readily appreciated as the same becomes better understood by reference to the following detailed description when considered in connection with the accompanying drawings, in which like reference numerals designate like parts through our the figures thereof and wherein.

DESCRIPTION OF THE EMBODIMENTS

Figure 1:
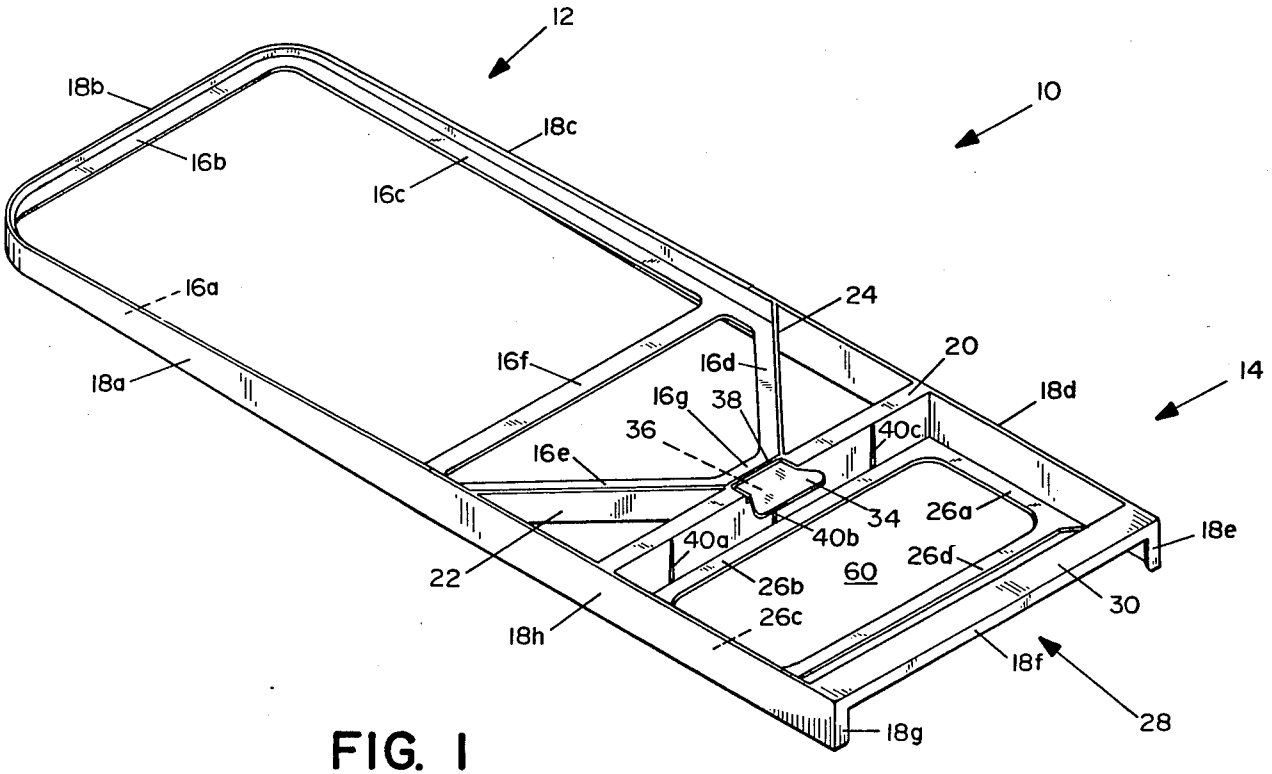
FIG. 1 illustrates a perspective view of the present invention.

FIG. 1 illustrates a perspective view of a security package 10 including a handle structure 12 and a rectangular encompassing structure 14. Opposing mirror like surfaces of the security package are substantially symmetrical in construction with the exception of a back retainer bar and a retaining bar-pin structure, as later described in detail.

The security package 10 is formed about a flat configured planar member **16*a*–16*g* with encompassing retainer rims 18*a*–18*h* which extend substantially equally above and below the perimeter member 16*a*–16*g* as illustrated. The sections 18*a* and 18*c* are tapered downwardly from 18*h* and 18*d*, respectively, as illustrated, to meet rim portion 18*b*, and are of a lesser height than the other sections of the encompassing retainer rim 18, by way of example and for purposes of illustration only and not to be construed as limiting of the present invention. A configured vertical channel 20, extends between inbound ends of the rim portions 18***d* and 18*h*. Angled rectangular support bar members 22 and 24 extend between the vertical channel 20 and perimeter member 18*h*, and vertical channel 20 and perimeter member 18*d* respectively and are perpendicular to planar members 16*e* and 16*d*, respectively, as illustrated.

Perimeter wall members 18*d*, 18*e*, 18*f*, 18*g*, and 18*h* form the sides of the rectangular encompassing structure 14. A flat configured planar member 26*a*, 26*b* and 26*c* extends as illustrated along and between the lower edges of vertical channel 20 and outer perimeter members 18*d* and 18*h*. A retainer bar 26*d* likewise extends between the lower edges of outer perimeter members 18*d* and 18*h* to form the bottom of the encompassing structure 14. Perimeter members 18*e*, 18*f*, and 18*g* form an end of the encompassing structure 14, and also form a cassette viewing port 28 for viewing of contents such as identification or titles. The top of the rectangular encompassing structure 14 is a planar surface 30 extending along and perpendicular to retainer rim 18*f*, and between the upper edges of the extreme ends of perimeter members 18*d* and 18*h* thereby enhancing structural integrity of the ends of the encompassing structure 14 and thereby serving to hold down a portion of the enclosed contents.

A containment retainer bar-pin 34 engages within an orifice and rectangular cutout 36 in vertical channel 20 to hold down and secure the contents within the rectangular encompassing structure 14 as later described in detail. A vertical anti-pry bar 38 extends upwardly from planar member 16*g* across one edge of the rectangular cutout 36 to preclude attempts to pry and dislodge the bar-pin 34 from the vertical channel 20. The anti-pry bar 18 also prevents misalignment of the bar-pin 34 within vertical channel 20. Tapered strengthener bars 40*a*–40*c* position on the face of vertical channel 20 enhancing structural integrity.

Figure 2:
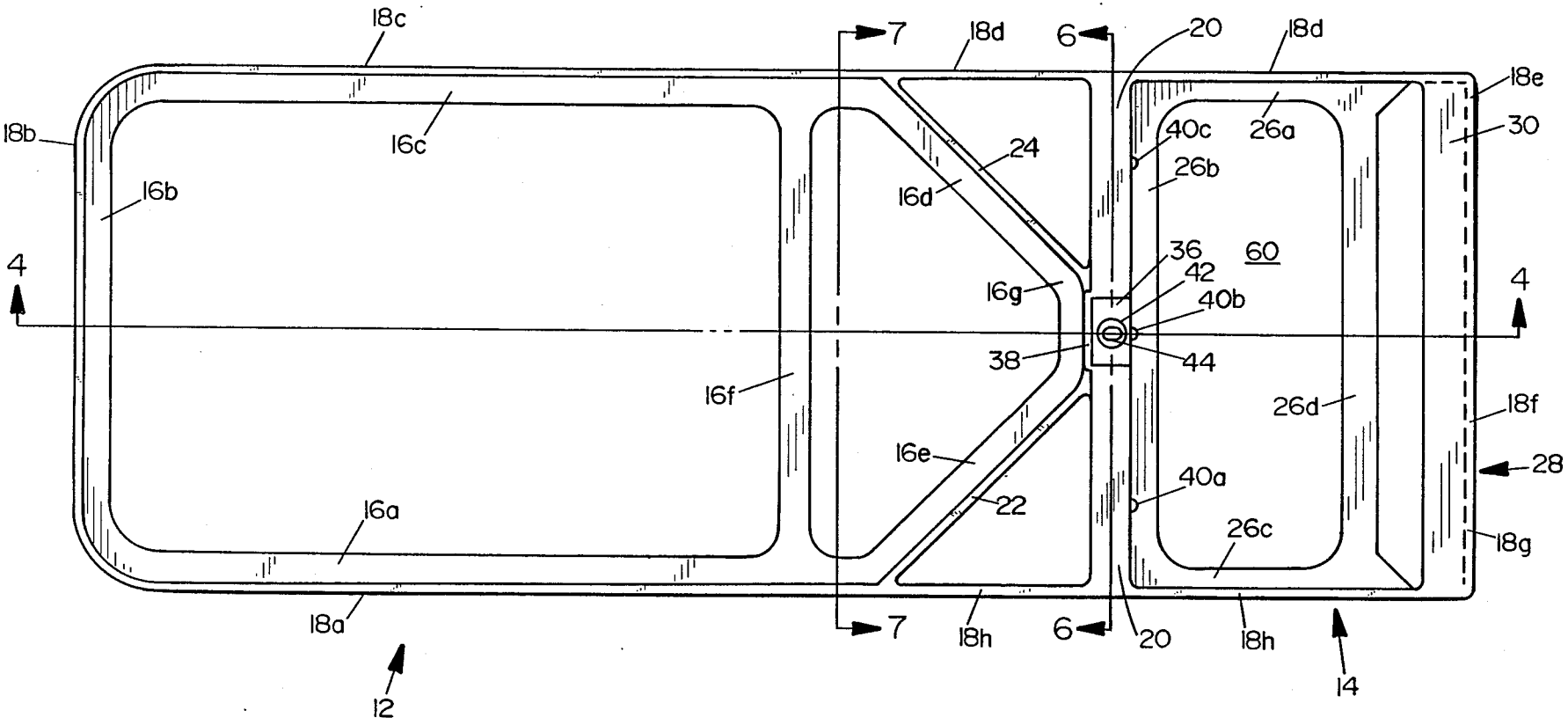
FIG. 2 illustrates a top view.

FIG. 2 illustrates a top view of the security package 10 where all numerals correspond to those elements previously described. Particularly noted is the round bar-pin engagement orifice 42 and elongated bar-pin orifice 44 positioned in vertical channel 20. The bar-pin 34 is removed for clarity of illustration.

Figure 3:
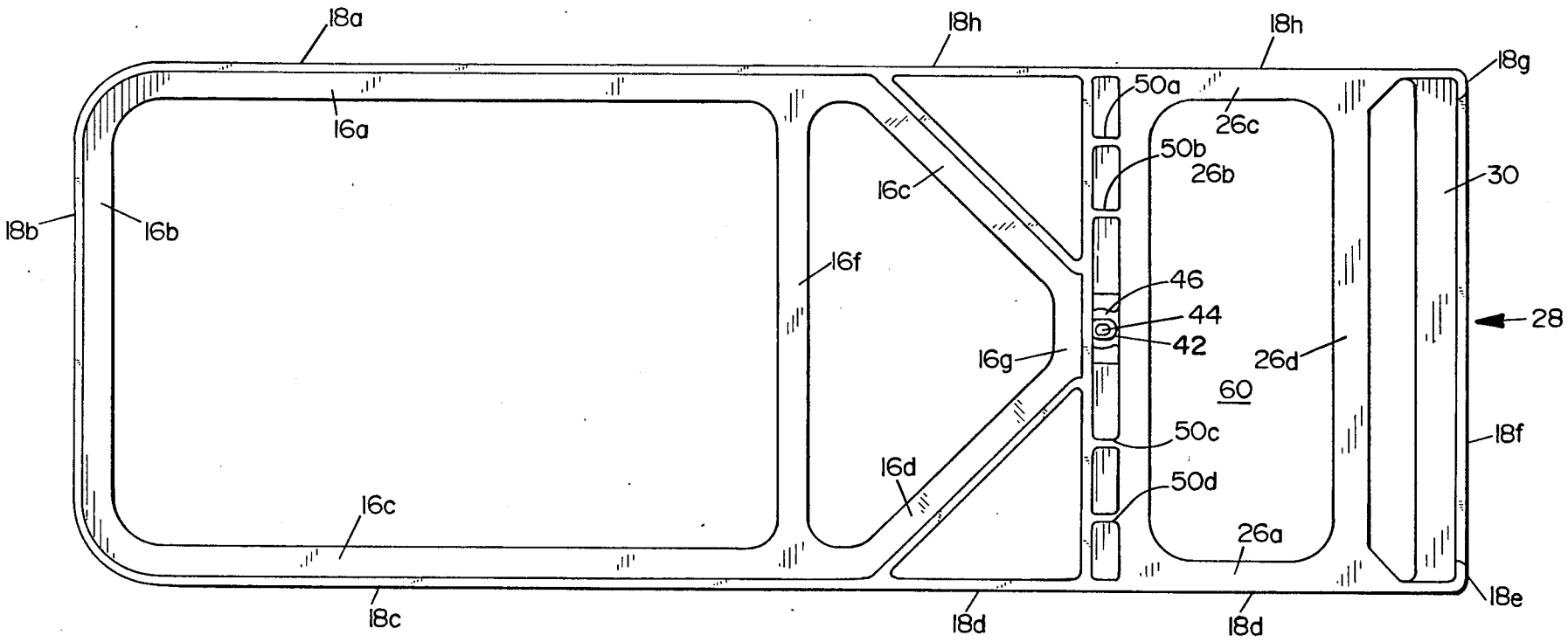
FIG. 3 illustrates a bottom veiw.

FIG. 3 illustrates a bottom view of the security package 10, where all numerals correspond to those elements previously described. Orifice wall member 46 positions integrally in the configured vertical channel 20 to form round orifice 42 on the opposing top side and elongated oval orifice 44. Strengthener struts 50*a*–50*d* position internally within channel member 20 enhancing structural integrity.

Figure 4:
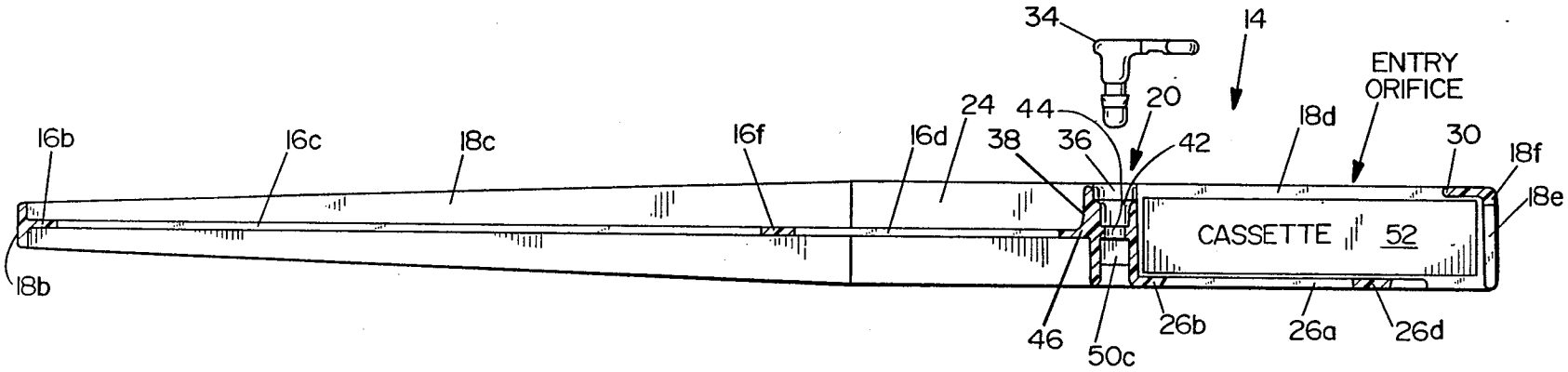
FIG. 4 illustrates a cross sectional side view taken along line 4—4 of FIG. 2.

FIG. 4 illustrates a cross section view taken along line 4—4 of FIG. 2, where all numerals correspond to those elements previously described with a cassette box 52 encompassed in the encompassing structure 14, before the containment bar-pin 34 is secured into orifices 42 and 44.

Figure 5:
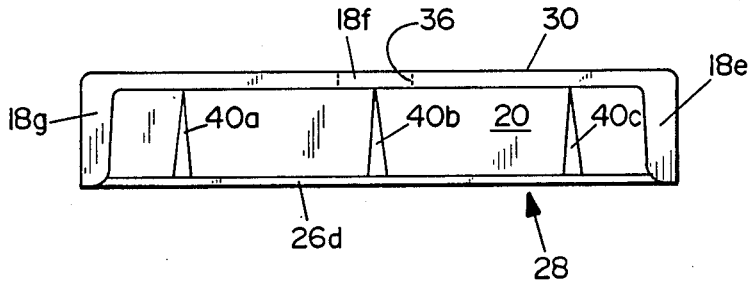
FIG. 5 illustrates a front end view.

FIG. 5 illustrates an end view of the security package 10 where all numerals correspond to those elements previously described, and illustrating the contents viewing port 28 formed by perimeter elements 18*e*–18*g*.

Figure 6:
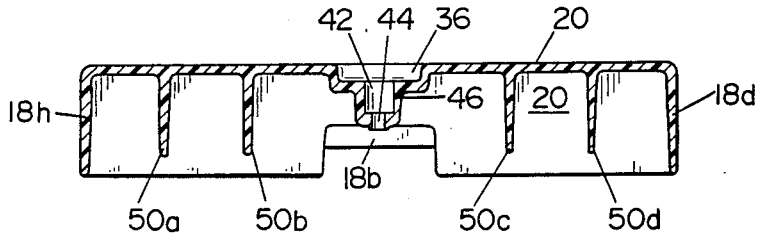
FIG. 6 illustrates a cross sectional end view taken along line 6—6 of FIG. 2.

FIG. 6 illustrates a cross sectional view taken along line 6—6 of FIG. 2 where all numerals correspond to those elements previously described, and illustrating the integral rectangular cutout 36, orifices 42 and 44, orifice wall member 46 and struts 50*a*–50*d* in channel member 20.

Figure 7:
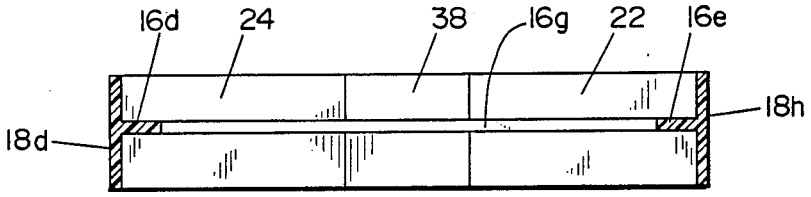
FIG. 7 illustrates a cross section taken along line 7—7 of FIG. 2.

FIG. 7 illustrates a cross section view taken along line 7—7 of FIG. 2 where all numerals correspond to those elements previously described.

Figure 8:
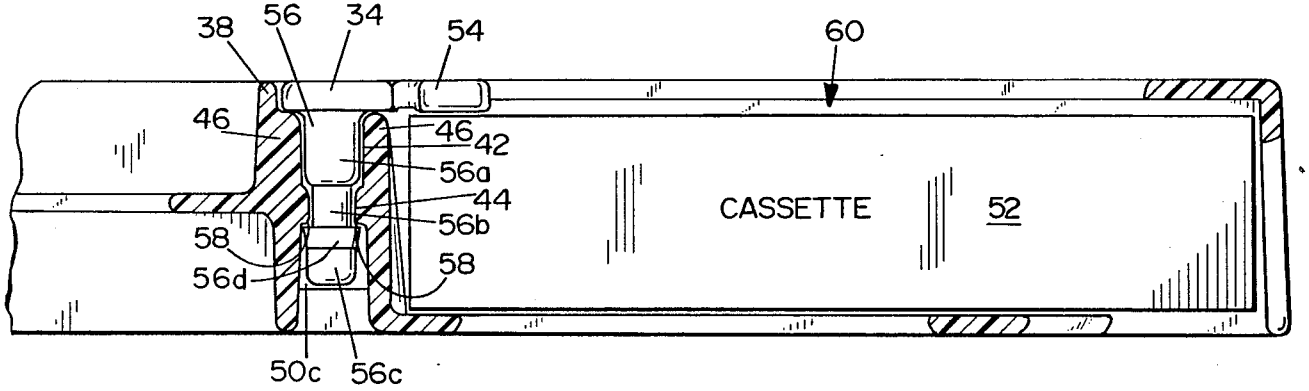
FIG. 8 illustrates in partial cross section a cassette secured within the security package by the bar-pin.

FIG. 8 illustrates in cross section a package 52 secured within the security package 10 by the bar-pin 34 where all numerals correspond to those elements previously described. Containment bar-pin 34 includes planar bar element 54 which extends over and secures a cassette package 52 or other package box like member within the encompassing structure 14. Molded configured pin 56 of the bar-pin 34 includes a cylindrical shaft 56*a*, an elongated oval shaped shaft 56*b* for engagement into an integrally elongated hole 44, and a flared elongated essentially oval cross section pin tip 56*c*. The flared portion 56*c* frictionally engages against the surface area 58 immediately below elongated hole 44 preventing removal of the bar-pin 34 unless acted upon by a strong forceful superior pin dislodging force, pressing against the tip portion of member 56*c*. It is also noted that the anti-pry bar 38 will not allow the bar pin 34 to engage and lock within orifice 44 due to restricting geometrical limitations allowing for one and only one proper orientation for locking. The cassette box 52 is inserted through a loading orifice 60 accordingly and then locked in place by manually or mechanically engaging bar-pin 34 as illustrated until the flared ring 58*d* frictionally engages below the surrounding surfaces 58 of hole 44 thus locking the cassette 52 within the described confines of the encompassing structure 14 and the associated structural members.

Figure 9:
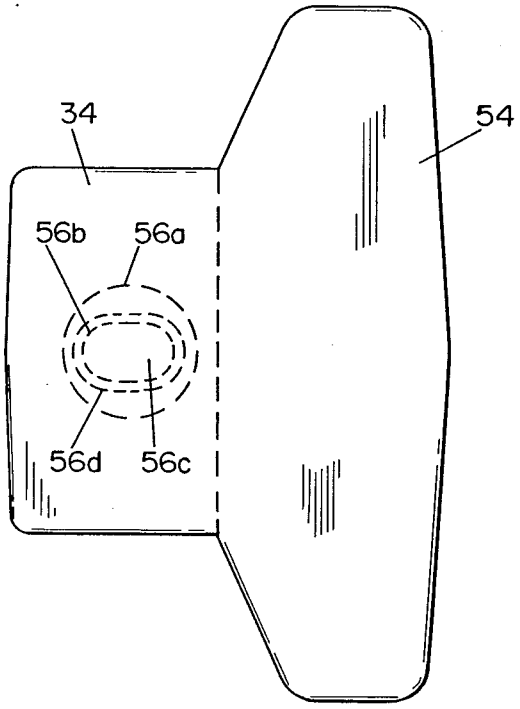
FIG. 9 illustrates a top view of the bar-pin.

FIG. 9 illustrates a top view of the bar-pin 34 where all numerals correspond to those elements previously described. Particularly illustrated are the strength enhancing elongated oval portions 56*b*, 56*c*, and 56*d* which also align the bar-pin 34 within orifices 42 and 44.

Figure 10:
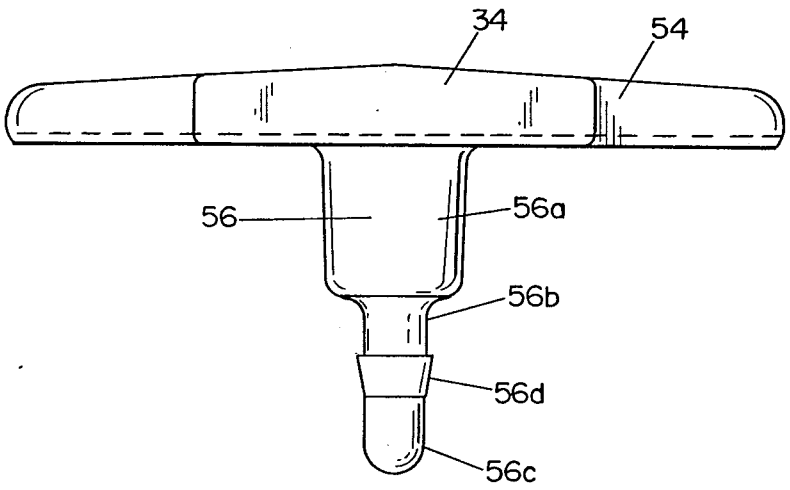
FIG. 10 illustrates an end view of the bar-pin.

FIG. 10 illustrates an elevation view of the bar-pin 34 where all numerals correspond to those elements previously described.

MODE OF OPERATION

The use and operation of the present invention is very aptly described in that one loads the audio or video package, in through the cassette loading orifice 60, into the interior of the encompassing structure 14, and then inserts a containment bar-pin, 34 through and into hole 42. A degree of pressure is required to insert the containment bar-pin 34, which can either be done digitally with fingers or with light tapping of a hammer; or, in the alternative with a containment bar-pin 34 pressure machine or like pressure applied for pushing the containment bar-pin 34 down into the holes 42 and 44 with subsequent snapping of the flared tip 56 through hole 44. One object is having considerable frictional engagement to prevent one from removing the pin at the slightest whim with just finger pressure. The box is supported and retained with the rectangular area 14 between the perimeter members 18*d*–18*h*, planar members 30, 26*a*–26*d*, channel member 20, and also held in position by the bar-pin 34. The lower retainer bar 26*d* is slightly offset, providing for security of the package 10. The containment bar-pin 34 "blocks" removal of the box 52 from the encompassing structure 14.

When it is desired to remove the box, the same machinery for inserting the bar-pin can be used to push a bar-pin backwards through and out of the hole. A store could retain the security package for further use, or return a package to the point of sale. The other alternative is to use a pair of scissors, wire cutters or heavy-duty shears for cutting and separating the lower retaining bar of the structure for removal of the box.

Various modifications can be made to the present invention without departing from the apparent scope thereof.

We claim:

1. A reuseable security package comprising:

a. an elongated handle defining a plurality of openings, and integral therewith a rectangular encompassing structure having sides defining a width dimension, a top, a bottom, and a retaining bar extending between two sides across the bottom of said structure and defining an orifice for accepting a box;

b. said encompassing structure having a containment hole extending through the surface area of said encompassing structure and essentially parallel to said sides, said containment hole being of a dimension smaller than the width of said encompassing structure for receiving a locking pin;

c. a discrete containment bar having a retaining element with said locking pin, said retaining element having a portion adapted to extend over said box to block removal thereof without first removing said containment bar; and, d. said locking pin having a flared portion thereof adapted to engage the surface area of said encompassing structure adjacent said hole whereby said bar is retained in position to prevent removal of said box from said package until said bar is released by the application of pressure against said locking pin.

2. A reuseable security package comprising:

a. an elongated handle defining a plurality of openings, and integral therewith a rectangular encompassing structure having sides defining a width dimension, a top, a bottom, and a retaining bar extending between two sides across the bottom of said structure and defining an orifice for accepting a box;

b. said encompassing structure having a containment hole for receiving a locking pin said containment hole extending through the surface area of said encompassing structure and essentially parallel to said sides, said containment hole being of a dimension smaller than the width of said encompassing structure, and a recess on said surface area adjacent said hole, for receiving a planar retaining element;

c. a discrete containment bar bearing thereon said planar retaining element and said locking pin;

d. said planar retaining element having a first portion thereof adapted to fit within said recess and a second portion adapted to extend over said box to block removal thereof without first removing said containment bar; and, e. said locking pin having a flared portion thereof adapted to engage the surface area of said encompassing structure adjacent said hole whereby said bar is retained in position to prevent removal of said box from said package until said bar is released by the application of pressure against said locking pin.

3. A package according to claim 1 wherein said planar retaining element and said recess are shaped to allow insertion of said containment bar in only one orientation of said retaining element.

4. A package according to claim 3 wherein the top surface of said planar retaining element is flush with the surface area of said encompassing structure when said containment bar is in place.

5. A package according to claim 4 wherein the end of said locking pin opposite said surface area is accessible from the side of said package opposite the planar retaining element to allow said pin to be forced out of said hole.

* * * * *